US005664674A

United States Patent [19]

Lynch, Jr.

[11] Patent Number: 5,664,674

[45] Date of Patent: Sep. 9, 1997

[54] TOOTHPICK HOLDER AND DISPENSER

[76] Inventor: Edward H. Lynch, Jr., 121 91st St., Rockaway Park, N.Y. 11693

[21] Appl. No.: 664,684

[22] Filed: Jun. 17, 1996

[51] Int. Cl.[6] ..... B65D 85/24

[52] U.S. Cl. ..... 206/382; 206/380; 206/443; 206/459.5

[58] Field of Search ..... 132/321; 206/380, 206/382, 383, 443, 459.5; 283/117

[56] References Cited

U.S. PATENT DOCUMENTS

| | | | |
|---|---|---|---|
| 1,819,451 | 8/1931 | Wissig | 206/382 |
| 1,856,559 | 5/1932 | Johnson | 206/380 |
| 3,331,499 | 7/1967 | Jost | 206/380 |
| 3,647,057 | 3/1972 | Ashmead et al. | 206/380 |
| 4,637,512 | 1/1987 | Smith | 206/382 |
| 5,067,611 | 11/1991 | Hagmann et al. | 206/380 |

*Primary Examiner*—Jimmy G. Foster
*Attorney, Agent, or Firm*—Steven Horowitz

[57] ABSTRACT

A rhombus-shaped toothpick holder for connected triangular toothpicks in a way that avoids toothpicks accidentally exiting the holder and poking someone is defined by a rear surface, four connected walls and a front bottom cover member that opens outwardly for insertion of the toothpicks and snaps closed. The front surface of the connected toothpicks inside the holder is smooth for the display of a logo on it except for spaces between the toothpicks at or near its top whereas the back of the connected triangular toothpicks appear accordion-like. The inside surface of the holder's rear surface has an identical logo displayed thereon so that as toothpicks having portions of the logo are dispensed the logo remains visible and whole. Alignment markers keep the logos aligned. To fit into spaces between the toothpicks and thereby prevent their movement, ribs of gradually increasing height are provided at a lower end of the inside rear surface at an area corresponding to that of the cover member. Upper slit openings and a notch opening ending at the corner of two adjoining walls at the end of the holder where toothpicks are removed allows a broken off toothpick to be slid out of the holder by the use of one hand since the rear surface is flexed back at that upper corner, the rhombus shape further preventing accidental removal of the toothpicks. A safety bar is provided across the top surface.

16 Claims, 2 Drawing Sheets

FIG.6
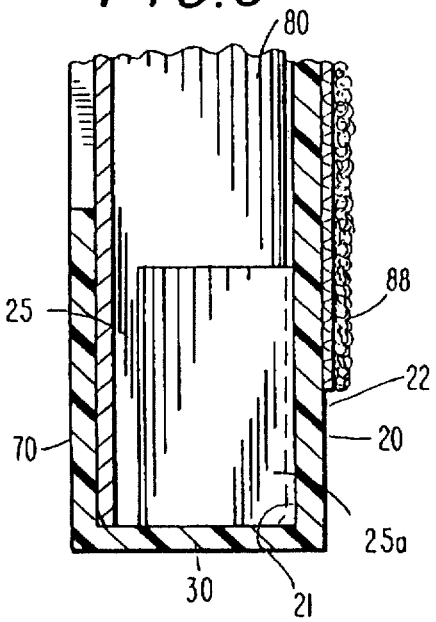
FIG.7
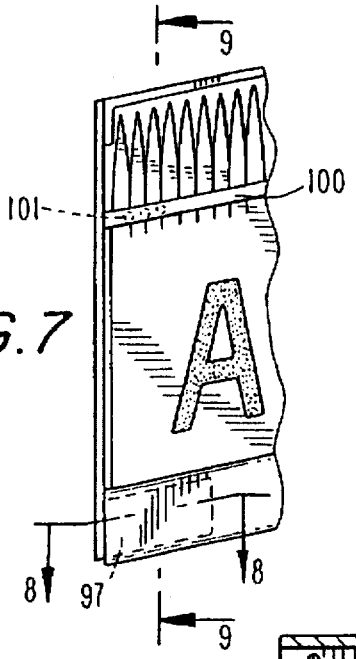
FIG.8
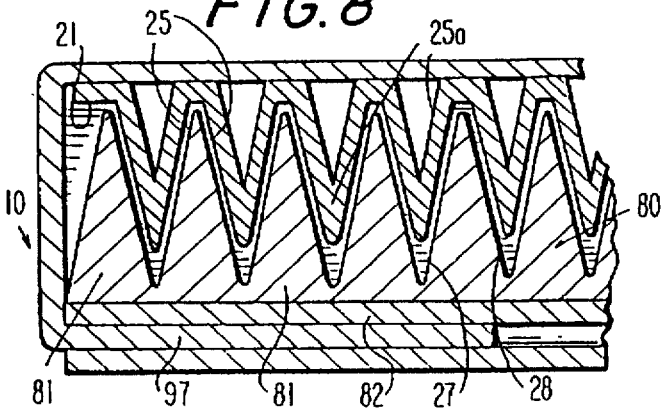
FIG.9
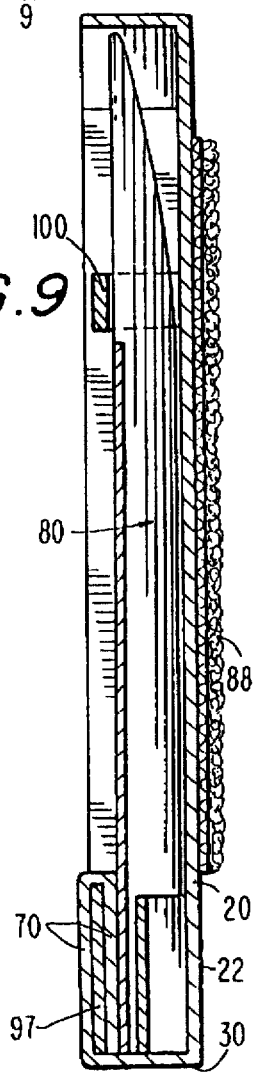
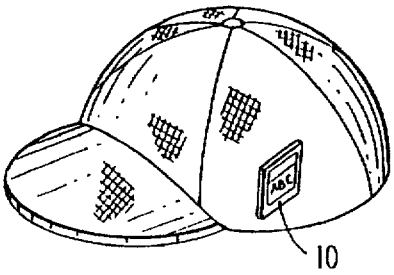
FIG. 10

TOOTHPICK HOLDER AND DISPENSER

The present invention relates to improvements in containers or holders for flat shaped toothpicks and in particular allows the user to access to such individual toothpicks safely and easily in a holder shaped like a matchbook.

Toothpicks are well known for cleaning away food or placque from between teeth and are sometimes held in one's mouth even when not to clean the teeth. Accordingly people often wish to carry toothpicks with them. When a person wishes to carry toothpicks in a holder attached to his or her person in a manner that allows easy access to individual toothpicks by one hand, a problem of safety arises since the edge of the toothpicks are sharp and since the holder must protect the toothpicks from separating or piercing the container or poking the person detaching a toothpick while at the same time allowing safe and easy access to individual toothpicks, preferably access that can be made use of with only one hand.

Toothpick holders and dispensers suffer from operational disadvantages in that they are either bulky or complex or if simple they do not sufficiently maintain the safe storage of the toothpicks while at the same time allow easy manual access to them. To enhance access to them and maintain cleanliness, it is known to have toothpicks connected to one another but individually detachable. Easy and safe detachment of connected toothpicks by one hand without having to remove the entire group of connected toothpicks from the holder is a desirable objective.

"Flat shaped" or "triangular" toothpicks, i.e. toothpicks that have flat shaped lengthwise edges, that are detachably connected on one side to form a surface are known and they provide a convenient way of separating and dispensing toothpicks. It is also known to hold flat shaped toothpicks in a square container the size of a matchbox, approximately 2 inches by 2 inches, wherein the lower end of the toothpicks are joined together on one side by a continuous wooden (the material toothpicks are made of) detachably connected "web" piece that allows for individual toothpicks to be broken away and where the other side looks like a miniature accordion.

The present invention achieves easy and safe detachment of connected toothpicks by one hand without having to remove the entire group of connected toothpicks from the holder in an improved safe, efficient and clean manner using a rhombus shaped container—roughly the size of a matchbox although the invention is not limited to this exact size—and having a cover member resembling that of a small matchbox and which is attachable to an apparel article such as a casual-style or baseball hat, on the back side of the holder. A further object of the present invention is to provide such a lightweight portable toothpick case and dispenser that displays a logo or decal on the front face of the connected "web" of toothpicks even as a greater and greater portion of the connected toothpicks has been detached and used by virtue of an identical logo being displayed beneath the connected toothpicks on the inside rear surface of the holder.

An additional object of the present invention is to provide a holder for flat shaped toothpicks connected together wherein the container or holder is of the size commonly used to hold matches and wherein the inside rear surface of the holder includes a lower ribbed area for embedding the triangular edges of the toothpicks to keep them in place, alignment markers for aligning a logo on the toothpicks with a logo on the holder whereby the ribs also maintain the toothpicks in a clean and sanitary condition prior to the toothpicks being dispensed one by one.

Another object of the present invention is to provide a safe rhombus shaped "matchbook" type (i.e. having the approximate size of a matchbox although the invention is not limited to this size and having a cover member in the front) holder of flat shaped toothpicks having features that facilitate removal of the toothpicks, e.g. at the end of the holder where toothpicks are being removed there is an upper slit at ends of adjacent bendable back walls of the holder and a notch at the end of the upper wall that allow easy removal of the toothpicks.

A still further object of the present invention is to provide a safe rhombus shaped "matchbox" type holder wherein in order to further facilitate separation and extraction of toothpicks at the end of the holder where the toothpicks are being removed, the lower ribbed area contains gradually increasing ribs where ribs of the lowest height are at the end of the holder where the toothpicks are being extracted.

A further object of the present invention is to provide a safe rhombus shaped "matchbox" type (i.e. having the approximate size of a matchbox although the invention is not limited to this size and having a cover member in the front) holder of flat shaped toothpicks wherein a safety strap across the front of the holder parallel to two of the walls prevents the sharp toothpicks from hurting someone accidentally and wherein for extra stability there are optionally provided bumps under the safety strap at the opposite end of the holder to where toothpicks are extracted.

BRIEF DESCRIPTION OF THE DRAWINGS

A preferred embodiment of the holder of the present invention is provided as illustrated by reference to the following drawings:

FIG. 6 is a cross-sectional view of the holder of the present invention taken along line 6—6 of FIG. 2.

FIG. 7 is a partial front view of an alternative embodiment of the holder of the present invention.

FIG. 8 is a cross-sectional view of the alternative embodiment of the holder of the present invention taken along line 8—8 of FIG. 7. FIG. 9 is a cross-sectional view of the alternative embodiment taken along line 9—9 of FIG. 7.

FIG. 10 is a perspective view of the holder of the present invention attached to an article of clothing.

DETAILED DESCRIPTION OF THE DRAWINGS

Figure 1:
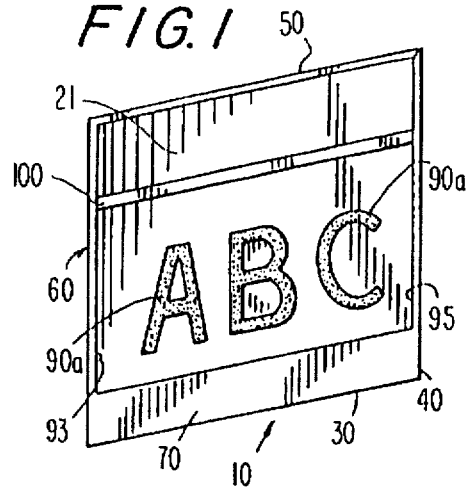
FIG. 1 is a front view of the toothpick holder of the present invention.
Figure 2:
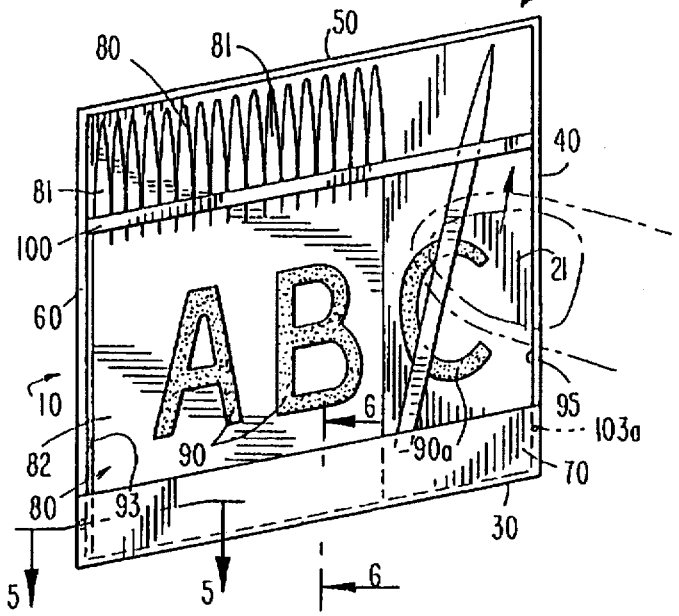
FIG. 2 is an front view of the holder of the present invention with the toothpicks in it.
Figure 3:
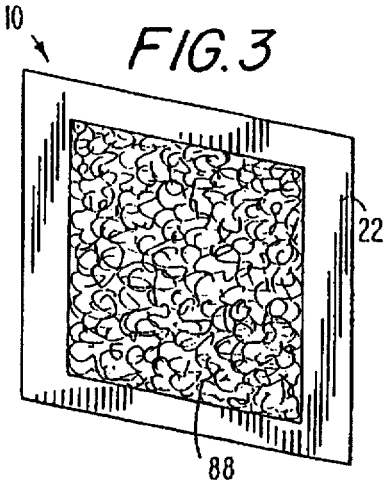
FIG. 3 is a rear view of the holder of the present invention

As is seen from FIGS. 1–3, toothpick holder 10 is substantially in the shape of a parallelogram of four equal sides, sometimes referred to as a rhombus, that creates four angles formed by the adjoining of adjacent sides. Since two of the four angles are only a little greater than 90 degrees and two of whose angles are only a little less than 90 degrees, the shape of holder 10 may be described herein as a "mild" rhombus. Although not limited to this, the rhombus' angles may vary from 50 to 75 degrees and is therefore somewhat more deviant from a square than the rhombus depicted in FIGS. 1–2.

Toothpick holder 10 is box-like in that it is generally defined by rear surface 20, having an inside 21 and an outside 22, and going counterclockwise, by bottom wall 30, side wall 40, top wall 50, and side wall 60. Bottom wall 30 is generally parallel to top wall 50 and the two side walls 40, 60 are generally parallel to one another. The three dimensional height of the holder, i.e. the height perpendicular to rear surface 20, is only slightly greater than the height of "flat shaped" toothpicks having triangular lengthwise shape, as described further below, so that a snug connection is maintained. Holder 10 is made from one integrated unit or mold of any flexible material such as flexible semi-rigid plastic or in an alternative embodiment from cardboard or thick paper. Cover member 70 is flat and is parallel to rear surface 20 and extends from lower wall 30 covering approximately the bottom fifth of toothpicks 80 and of rear surface 20. In order to insert toothpicks 80 into holder 10, cover member 70 opens outward and downward (moving up to ninety degrees in rotation) along the edge that it has in common with wall 30. When cover member 70 is in open position, toothpicks 80 can still stand on bottom wall 30 which does not open. Cover member 70 attaches to walls 40, 60 when in closed position. This can be accomplished, for example, by having protrusions 103 perpendicular to cover member 70 and on the left and right sides, respectively, of cover member 70 easily snapping into indentations 103*a* in walls 40, 60 corresponding. Other convenient attachment means can be envisioned such as, for example, any suitable male projecting part on cover member 70 with a female part in walls 40, 60. The invention is not limited to the exact method of attachment.

In an alternative embodiment, if the holder 10 is made of thick paper or cardboard, the cover member 70 of holder 10 may be one simple piece as the rest of holder 10 or alternatively may be formed by folding onto itself whereby in the space between the folds are inserted opposing flaps 97 extending from the lower fifth of side walls 40, 60 as described further herein.

Figure 5:
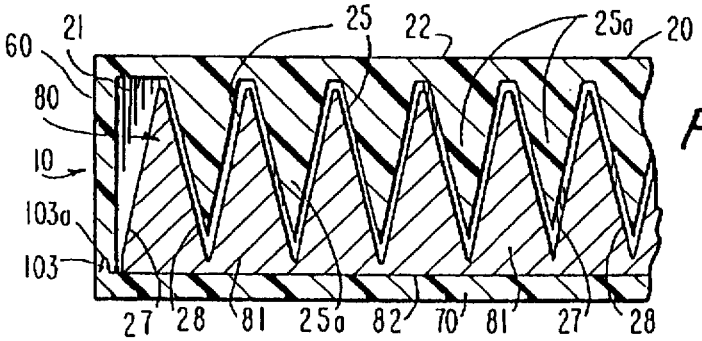
FIG. 5 is a cross-sectional view of the holder of the present invention taken along line 5—5 of FIG. 2.

As seen in FIGS. 2 and 5, connected toothpicks 80 are composed of individual toothpicks 81 of equal size and shape but which are arranged next to one another so as to form, as a group, a parallelogram of four equal sides slightly smaller but of the same shape as holder 10. The top exposed face or surface 82 of connected toothpicks 80 have a flat smooth surface wherein spaces are allowed between the toothpicks at one end thereof for easy detachment. As seen in FIGS. 2 and 5, the unexposed underside of connected toothpicks 80 appear accordion-like as separable individual toothpicks 81 whose triangular lengthwise edges 27, 28 fit into corresponding grooves 25 at an area on the lower fifth of inside 21 of rear surface 20. The grooves 25 are valleys adjacent ribbed protrusions 25*a*, or ribs 25*a*, and they keep the toothpicks 80 in place and separate from one another and prevent horizontal movement that can lead to accidental poking by an edge of a toothpick.

Grooves 25 and ribs 25*a* are not visible from the outside surface 22 of rear surface 20 of holder 10 since they are obscured by cover member 70. As best seen in FIG. 6, which is a cross-sectional view taken along line 6—6 of FIG. 2, the grooves 25 and ribs 25*a* begin at the lower wall 30 and extend along inside 21 of rear surface 20 only as far as cover member 70 extends so as not to interfere with the image of a decal or logo 90*a* on the inside surface 21 of rear surface 20. In addition, the height of ribs 25*a* gradually vary so that ribs 25*a* are of lowest height at the end of holder 10 where the individual toothpicks 81 are removed and gradually rise in height so that at the opposite end the ribs 25*a* generally correspond in height to the space between the triangular toothpicks. Although as indicated ribs 25*a* add stability to the toothpicks 80 by keeping them in place, the fact that ribs 25*a* are not of full height at the end of holder 10 where toothpicks are removed makes it easier to separate an individual toothpick 81 from connected toothpicks 80 by moving it horizontally away from connected toothpicks 80 and then removing it, as described further below.

As seen in FIGS. 1–2, top surface 82 of connected toothpicks 80 allows for decal or logo 90 to be depicted thereon. An identical decal or logo 90*a* is depicted on inside 21 of rear surface 20 of holder 10. In order to maintain perfect alignment between decals 90 and 90*a* so that when individual toothpicks 81 are detached the appearance of logo or decal 90 remains the same (by exposing the identical corresponding portion of logo or decal 90*a*), there are alignment markers 93, 95 adjacent opposite side walls 40, 60 that jut out slightly perpendicular to inside 21 of rear surface 20 of holder 10. Alignment markers 93, 95 are of the same material as the rest of holder 10 and also further prevent horizontal motion by connected toothpicks 80 that could lead to accidental poking by a sharp end of a toothpick.

As seen in FIGS. 1–2, thin safety strap 100 is parallel to and spaced apart from the flat cover member 70 and it crosses the front of holder 10 at an upper portion of the holder 10. The safety strap 100 and cover member 70 further maintain the toothpicks 80 in stationary relation to holder 10 so that the decal 90 remains aligned with the decal 90*a*. The width of safety strap 100 must be thin enough so as not to unduly obscure a decal or logo 90 on the face of connected toothpicks 80. Optionally, as seen in the alternative embodiment in FIG. 7 (although this feature can also appear in the preferred embodiment), for additional stability safety strap 100 has a series of bumps 101 under the strap 100 projecting from the inside 21 of rear surface 20 under the safety strap 100 at the end of holder 10 opposite to the end where toothpicks are removed. The additional stability is useful particularly on that end (the end opposite to where toothpicks are removed) of holder 10 because after a portion of toothpicks 80 have been removed the risk of the remaining toothpicks 80 on that end moving about in holder 10 increases.

It should be noted that the mild rhombus shape of holder 10 makes it more difficult for toothpicks to accidentally be removed from holder 10 and poke someone since even if a toothpick 81 is separated accidentally from connected toothpicks 80 by a jolt or otherwise, that toothpick 81 cannot, if inadvertently rotated relative to toothpicks 80, find room to emerge from holder 10. For example, if a detached toothpick 81 inadvertently tried to rotate toward the remaining toothpicks 80 (counterclockwise with the base of the toothpick as a fulcrum), the detached toothpick 81 would be blocked by wall 50. The angles of the parallelogram defined by the walls 30, 40, 50, 60 of holder 10 deviate so much from 90 degrees as to make the holder 10 accomplish the purpose as described.

Figure 4:
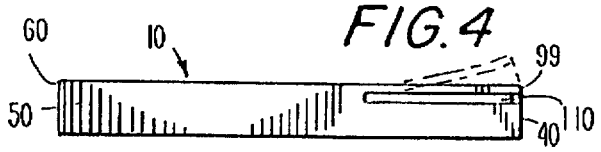
FIG. 4 is a top plan view of FIG. 1 in closed condition.

FIG. 4 is a top plan view of FIG. 1 showing the toothpick holder in closed condition wherein slit opening 99 can be seen. As seen in FIGS. 2 and 4, by a simple manual operation wherein the hand grasps holder 10 and the fingers press against the detachable end of the outermost toothpick of connected toothpicks 80, slit opening 99 allows a toothpick that was detached from connected toothpicks 80 to be shoved upward and removed from holder 10 between rear surface 20 and the portions of top wall 50 and side wall 40 where toothpicks are removed. This is because as seen in FIG. 4, rear surface 20 is bendable and this flexibility is magnified at or near slit opening 99 so that the corner of rear surface 20 defined by adjoining walls 40 and 50 is bent back when the toothpick 81 is removed. At the same time, rear surface 20 is sufficiently elastic to snap back into its previous shape prior to the removal of another toothpick 81 from holder 10.

As seen in FIG. 4, slit opening 99 begins at the corner defined by adjoining walls 40 and 50 and runs along a portion of top wall 50 and a portion of side wall 40. Slit opening 99 should be less than a third of the length of each of the walls 30, 40, 50, 60 of holder 10. Notwithstanding slit opening 99, adjoining walls 40 and 50 remain connected to one another.

Parallel to, and of the same length as, the portion of slit opening 99 that runs along top wall 50 is rectangular notch opening 110 in top wall 50. Notch opening 100 is there in order to further facilitate removal of toothpick 81 when rear surface 20 is bent back at the intersection of adjoining walls 40 and 50. For safety reasons, to prevent poking accidentally, notch 110 is not wide enough to allow an individual toothpick 81 to be inserted through it without the user's intentional simultaneous bending back of rear surface 20 at the intersection of adjoining walls 40 and 50. Accordingly, notch 110 assists in the manual removal of toothpicks 81 by the use of one hand.

As seen in FIGS. 3, 6, 9, outside surface 22 of rear surface 20 has fabric attachment means 88 such as the fabric widely sold under the trademark "Velcro", adhesive, or another attachment means so that holder 10 can easily be attached to the surface of a baseball cap or other article of clothing from which the removal of toothpicks 81 can be accomplished without removing holder 10 from the clothing.

As seen in FIGS. 7–9, the alternative embodiment involves making the holder from cardboard, rather than plastic. In this embodiment, flaps or tabs 97 emanating from the lower portion of side walls 40, 60 fold into cover member 70, as seen in FIG. 7, since, as best seen in FIG. 9, cover member 70 folds onto itself thus creating a tight space between the folds for insertion of flaps 97. As seen in the alternative embodiment, FIG. 7, under safety strap 100 there are bumps 101 projecting from the inside 21 of rear surface 20 at that end of holder 10 opposite to the end where toothpicks are removed for additional stability. In the alternative cardboard embodiment, moreover, rear surface 20 consists of two layers so that the inside layer can provide ribs **25*a*** at a lower end thereof, as described.

It is to be understood that the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described.

What is claimed is:

1. A lightweight portable holder of connected detachable flat triangular toothpicks that have a smooth upper surface displaying a logo comprising:

a flat box-like rhombus shaped body defined by a flexible rear surface, four walls, a flat cover member covering a lower portion of toothpicks positioned inside the holder and a thin safety strap parallel to and spaced apart from said flat cover member at an upper portion of the holder, the rear surface having ribs, between which toothpicks lodge to hold the toothpicks stationary on an inside of the rear surface in an area of the rear surface covered by the flat cover member, said flexible rear surface having a logo on its inside and having alignment markers adjacent opposite side walls projecting perpendicularly from said flexible rear surface for alignment of the logo on the toothpicks with the logo on the flexible rear surface, said flexible rear surface also having an upper slit along a portion of two adjoining walls and one of the adjoining walls having a rectangular notch whose width is smaller than that of any toothpick parallel to said upper slit along an upper wall for removal of detached toothpicks.

2. The holder of claim 1, wherein the cover member opens ninety degrees outwardly for insertion of toothpicks.

3. The holder of claim 1, wherein the cover member opens ninety degrees outwardly for insertion of toothpicks and wherein the cover member snaps closed by means of protrusions on opposing sides thereof that snap into indentations in two opposing side walls of the four walls of the holder.

4. The holder of claim 1, wherein the ribs increase gradually in height so that the ribs on an end where the toothpicks are removed are the lowest in height.

5. The holder of claim 1, wherein an outside surface of said flexible rear surface has means for attaching the holder to apparel.

6. The holder of claim 1, wherein said flat cover member covers approximately the bottom fifth of toothpicks.

7. The holder of claim 1, wherein the safety strap has bumps projecting from said flexible rear surface underneath the safety strap on an end opposite that used for removal of toothpicks for extra stability.

8. The holder of claim 1, wherein the holder is made of cardboard and the cover member folds onto itself and in the space between the folds are inserted opposing flaps extending from the lower fifth of each side wall.

9. The combination of a lightweight portable holder together with connected detachable flat triangular toothpicks that is capable of displaying a logo comprising:

connected detachable flat shaped triangular toothpicks having spaces at one end of a smooth upper surface for easy detachment, said smooth upper surface displaying a logo aligned with an identical logo on the inside of a flexible rear surface of a holder, and having a lower surface with a lengthwise triangular shape that fits into grooves adjacent ribs in the holder, a flat box-like rhombus shaped body defined by a flexible rear surface, four walls, a flat cover member covering a lower portion of toothpicks positioned inside the holder and a thin safety strap parallel to and spaced apart from said flat cover member at an upper portion of the holder, the rear surface having ribs on its inside in an area of the rear surface covered by the flat cover member to hold the toothpicks stationary and having alignment markers adjacent opposite side walls projecting perpendicularly from said rear surface for alignment of detachable toothpicks, said flexible rear surface also having an upper slit along a portion of two adjoining walls and one of the adjoining walls having a rectangular notch whose width is smaller than that of any toothpick parallel to said upper slit along an upper wall for removal of detached toothpicks.

10. The combination of claim 9, wherein the cover member opens ninety degrees outwardly for insertion of toothpicks.

11. The combination of claim 9, wherein the cover member opens ninety degrees outwardly for insertion of toothpicks and wherein the cover member snaps closed by means of protrusions on opposing sides thereof that snap into indentations in two opposing side walls of the four walls of the holder.

12. The combination of claim 9, wherein the ribs increase gradually in height so that the ribs on an end where the toothpicks are removed are the lowest in height.

13. The combination of claim 9, wherein an outside surface of said flexible rear surface has means for attaching the holder to apparel.

14. The combination of claim 9, wherein said flat cover member covers approximately the bottom fifth of toothpicks.

15. The combination of claim 9, wherein the safety strap has bumps projecting from said flexible rear surface underneath the safety strap on an end opposite that used for removal of toothpicks for extra stability.

16. The combination of claim 9, wherein the holder is made of cardboard and the cover member folds onto itself and in the space between the folds are inserted opposing flaps extending from the lower fifth of each side wall.

* * * * *